United States Patent [19]

Gleason

[11] 3,956,654

[45] May 11, 1976

[54] LONG LIVED PROPORTIONAL COUNTER NEUTRON DETECTOR

[75] Inventor: Charles H. Gleason, Horseheads, N.Y.

[73] Assignee: Westinghouse Electric Corporation, Pittsburgh, Pa.

[22] Filed: Feb. 3, 1975

[21] Appl. No.: 546,848

[52] U.S. Cl. ..... 313/61 D; 313/93; 313/221; 313/224

[51] Int. Cl.[2] ..... H01J 17/20; H01J 39/32

[58] Field of Search ..... 313/61 D, 93, 221, 224; 250/390

[56] References Cited

UNITED STATES PATENTS

| | | | |
|---|---|---|---|
| 2,552,723 | 5/1951 | Koury | 313/93 |
| 3,860,845 | 1/1975 | Gleason et al. | 313/61 D |

*Primary Examiner*—Palmer C. Demeo

*Attorney, Agent, or Firm*—W. G. Sutcliff

[57] ABSTRACT

A proportional counter neutron detector in which the neutron absorptive material is isolated from the poly-atomic fill gas by a thin film of selected metal or metal oxide, which is substantially transmissive to neutrons, and is non-reactive with the dissociation products of the poly-atomic fill gas.

3 Claims, 1 Drawing Figure

LONG LIVED PROPORTIONAL COUNTER NEUTRON DETECTOR

BACKGROUND OF THE INVENTION

The present invention relates to radiation detectors and more particularly to proportional counter neutron detectors which are used in proximity to a nuclear reactor. The most widely used proportional counter neutron detector comprises an hermetically sealed member having a high neutron cross-section, neutron absorptive coating on the interior surface thereof, with a centralized electrically conductive collector electrode disposed within the sealed member. The chamber is filled with a mixture of inert gas and selected poly-atomic gases which improve the operational characteristics of the device. An incoming neutron is absorbed in the coating, and atomic particles are emitted which cause ionization of fill gas constituents producing electrons which are drawn to the collector electrode, which is connected to the recording electronic system. A widely used neutron absorptive material is boron-10 isotope, which upon neutron absorption emits charged helium and lithium particles. These particles deposit their kinetic energy in the fill gas upon traversing the fill gas. Ion pairs and electrons are produced from the fill gas, and the electrons are drawn to the positively charged collector electrode wire. With a properly designed counter and applied voltage, the electric field in the vicinity of the center wire is sufficiently high to enable the approaching electrons to make a succession of ionizing collisions, with the fill gas atoms. This avalanching or multiplication leads to the formation of a signal pulse which can be sensed by the external electronic package to register the detection of a neutron capture.

The fill gas typically used is selected to have an adequately low ionization potential, and for its characteristic of producing ion pairs from interaction with the charged particles. The noble gases fit these requirements, and argon is widely used as the noble gas material. It has been found that the signal pulse sharpness, or rate of rise of signal, is distinctly influenced by the electron drift velocity through the gas to the center wire, under the influence of the impressed electric field. The noble fill gases such as argon, offer rather low electron drift velocities. It has been the practice to add small amounts of poly-atomic molecular gases to the main noble gas fill to improve the electron drift velocity characteristic of the fill gas. Typically, the additive gas is present in an amount of about 5 volume percent of the total gas fill. This improvement in drift velocity is traceable to the ability of low-energy electrons to undergo inelastic collisions with the poly-atomic molecules.

The addition of the poly-atomic gas to the fill gas is also desired to serve as a photon absorptive constituent within the ionization chamber. Photons may be produced in the ionization chamber as a result of excitation of the noble gas constituent. Such photons can cause excessive multiplication, which will show up as background noise level in the output electronics, or produce spurious counting events. In the extreme, voltage breakdown may be produced resulting in continuous conduction and inoperativeness of the device. The poly-atomic fill gas should be selected to be highly abosrptive of photon emission, which instead of producing re-emission of photons, results in dissipation of the photon energy by the dissocition of the poly-atomic molecule. It is desirable that the dissociation products of the poly-atomic gas molecule additive have the ability to recombine after dissociation, and commonly used poly-atomic gases which meet this requirement include carbon dioxide and boron trifluoride. It has been discovered that the neutron absorptive active element disposed on the interior wall of the ionization chamber presents a target for competitive combination with the dissociated molecules. This undesired wall combination prevents the desired recombination of the decomposition products back to the recombined molecule of poly-atomic gas additive. Thus, with high accumulated neutron exposure, or even with relatively low neutron exposure, with voltage applied, the recombination property of the gas diminishes. A portion of the dissociated products combine with the neutron absorptive material on the wall rather than with the gas constituent with which it was originally present as a poly-atomic molecule. It is desirable to isolate the boron-10 neutron absorptive material which is deposited on the wall, from the dissociation products of the additive gas. The dissociated gases will be prevented from recombining with the boron-10 coating, and will recombine as the gaseous poly-atomic fill gas molecule. The provision of an isolating coating over the neutron absorptive material to prevent combination of dissociated poly-atomic fill gas constituents with the neutron absorptive coating material can result in significantly improved operating life for the device.

SUMMARY OF THE INVENTION

A proportional counter neutron detector comprises an hermetically sealed member. A high neutron cross-section, neutron absorptive coating material is provided on the interior surface of the sealed member. A generally centralized electrically conductive collector electrode is disposed within the chamber defined by the sealed member. This electrode is insulatingly brought through the sealed member for connection to a potential source and electronic recording means. A fill gas is provided within the chamber substantially comprising inert noble gas with a small portion of poly-atomic fill gas a predetermined pressure. The poly-atomic fill gas is ionizable by the radiation emitted by the neutron absorptive coating. A thin isolating film of selected metal or metal oxide, which is substantially transmissive to neutrons and to radiation products emitted by the neutron capture coating, is disposed over the neutron absorptive coating. The isolating film is substantially non-reactive with the dissociation products of the poly-atomic fill gas.

BRIEF DESCRIPTION OF THE DRAWINGS

The sole FIGURE shows the proportional neutron detector in cross-section.

DESCRIPTION OF THE PREFERRED EMBODIMENT

Figure 1:
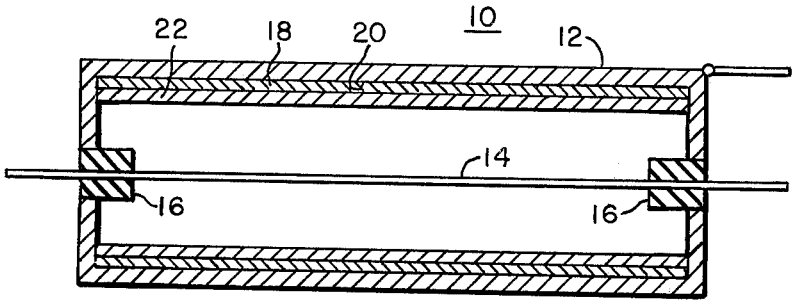

The proportional neutron detector 10 comprises an hermetically sealed enclosure member 12, which is specifically cylindrical, and formed of a material such as stainless steel. The centralized collector electrode wire 14 is disposed along the longitudinal axis of the enclosure member 12, and passes through insulated seal means 16 at opposite ends of the enclosure member 12. The electrode wires are externally connected to the electronic recording apparatus, and the conductive enclosure member is typically also connected thereto as the ground element. A thin coating of boron-10 neutron absorptive material 18 is disposed on the interior surface 20 of the enclosure member 12. This neutron absorptive coating is typically deposited in an amount of about one milligram per square centimeter. The chamber defined by the enclosure member has a fill gas of inert noble gas, typically argon, and a poly-atomic constituent, typically carbon dioxide in an amount of about 5 volume percent of the total fill gas. The carbon dioxide content can be readily varied from about 2 to 20 volume percent. A thin isolating film 22 is disposed over the neutron absorptive material coating 18 to effectively isolate the neutron absorptive material from the dissociation products of the poly-atomic fill gas constituent. The isolating film 22 is preferably a metal or metal oxide which is substantially transmissive to neutrons and neutron emission products, and is substantially non-reactive with the dissociation products of the poly-atomic fill gas. The isolation film is preferably aluminum or aluminum oxide and is deposited in an amount of about 0.02 to 0.2 mg. per square centimeter. The metal or metal oxide film prevents the dissociation products of the poly-atomic fill gas from contacting the boron-10 coating. In a detector in which the poly-atomic fill gas constituent is carbon dioxide, the metal or metal oxide thin isolation film should be selected to have a low oxygen affinity.

The isolative film 22 can be deposited by a thermal evaporation or gas sputtering application process which are well known in the art. The isolation film must be thin enough so as not to absorb a substantially portion of the energy of the charged particles produced as a result of neutron absorption, since any such decrease in the kinetic energy of these particles would reduce the number of ion pairs that can be formed in the fill gas and would degrade the performance characteristic of the device. Other poly-atomic fill gases which can be used include methane and boron trifluoride.

I claim:

1. A proportional neutron detector comprising an hermetically sealed member having a high neutron cross-section, neutron absorptive coating on the interior surface thereof, and a generally centralized electrically conductive collector electrode disposed within the sealed member and insulatingly brought through the member for connection to a potential source, a fill gas of noble gas and a small portion of a poly-atomic fill gas at predetermined pressure within said sealed member which fill gas is ionizable by the radiation emitted by the neutron absorptive coating upon neutron capture, the improvement wherein a thin isolation film of selected metal or metal oxide, which is substantially transmissive to neutrons and is non-reactive with the dissociation products of the poly-atomic fill gas, is disposed over the neutron absorptive coating.

2. The proportional neutron detector specified in claim 1, wherein the fill gas is carbon dioxide, and the metal or metal oxide thin film has a low oxygen affinity.

3. The proportional neutron detector specified in claim 1, wherein the metal or metal oxide thin film comprises aluminum or aluminum oxide in an amount of from about 0.02 to 0.2 milligram per square centimeter.

* * * * *